United States Patent [19]

Hackell

[11] 4,347,682

[45] Sep. 7, 1982

[54] BUBBLE FORMING DEVICES

[76] Inventor: Walter E. Hackell, 73 Alexander Ave., Napier, New Zealand

[21] Appl. No.: 149,985

[22] Filed: May 15, 1980

[30] Foreign Application Priority Data

Jun. 8, 1979 [NZ] New Zealand ..... 190685

[51] Int. Cl.[3] ..... A63H 33/28

[52] U.S. Cl. ..... 46/6

[58] Field of Search ..... 46/6, 7, 8

[56] References Cited

U.S. PATENT DOCUMENTS

| | | | |
|---|---|---|---|
| 486,967 | 11/1892 | Fickett | 46/6 |
| 517,118 | 3/1894 | Horton | 46/7 |
| 642,892 | 2/1900 | Bliss | 46/7 |
| 1,543,279 | 6/1925 | Crossman | 46/6 |
| 1,995,108 | 3/1935 | Schoepe | 46/6 |
| 2,542,100 | 2/1951 | Sturm | 46/6 |
| 2,710,487 | 6/1955 | Scott | 46/6 |
| 3,060,626 | 10/1962 | Panico | 46/7 |
| 3,323,250 | 6/1967 | Gibbons | 46/6 |
| 3,402,502 | 9/1968 | Kaysen | 46/6 |
| 3,952,447 | 4/1976 | Hackell | 46/6 |

*Primary Examiner*—F. Barry Shay

*Attorney, Agent, or Firm*—Cushman, Darby & Cushman

[57] ABSTRACT

A bubble-forming device is constructed of a shallow dish-shaped bubble engaging disc having a central opening spaced apart inner and outer circular walls forming an open ended chamber of annular cross-section located on the convex side of the disc, the open end of the chamber being in communication with the opening in the disc, the inner wall having a lateral aperture in communication with the annular chamber and having an air supply inlet opening concentric with the open end of the chamber and the opening in the disc, a detachable cover covering the opening in the disc and having an aperture which is located so that air entering the chamber via the inlet opening and the lateral aperture emits from the aperture in the cover over the surface of said disc.

8 Claims, 3 Drawing Figures

BUBBLE FORMING DEVICES

This invention relates to a bubble forming device, such a device being more particularly for amusement purposes.

The blowing of bubbles from a soap and water solution is well known and dates back many years to pipes having a stem with a bowl for reception of the soap and water solution. Such devices were only suitable for blowing bubbles of fairly small dimensions. In my New Zealand patent specification 171710 there is described and claimed a bubble forming device which allows the blowing of not only large dimension bubbles but also bubble formations such as long chains of bubbles. The device has proved to be successful but has suffered from a drawback in that a degree of skill has been required to be able to use the device and obtain the bubble formations. In addition the device was itself of large dimensions which resulted in not only a reasonably high manufactured cost but also led to packaging problems in view of its bulk. The device, whilst allowing greater versitility than the conventional and well known bubble pipe was itself of restricted versatility in view of its construction.

The aim of the present invention is to provide a bubble forming device which overcomes some or all of the aforementioned problems which existed with my earlier bubble forming device.

In its simplest and broadest form, the present invention provides a bubble forming device comprising a bubble engaging member, an air supply opening in said member through which air can pass to form a bubble which as it is being formed engages with said member and a cover which has at least one aperture formed therein, said cover being so positioned that air passing through said opening into said cover emits from said aperture or apertures.

In a preferred form the bubble engaging member is a rim at the open end of an open-ended annular chamber, the said air supply opening extending through a wall of said chamber at a point axially remote from said open end. The peripheral edge of said rim can be of curved cross-section. The aperture cover can be located within said annular chamber and positioned over the end of the air supply opening.

In a further form of the invention a dished disc is mounted on the open end of the annular chamber, said disc having a central opening which is in communication with said chamber. Preferably, the disc and opening are concentric with said chamber. The, or an additional, cover can be detachably mounted within said central opening in said disc.

In a preferred form the cover is formed by a cap having an end wall from which extends an annular wall, the or each aperture being formed in said annular wall.

To more fully describe the invention reference will be made to the accompanying drawings in which.

Figure 1:
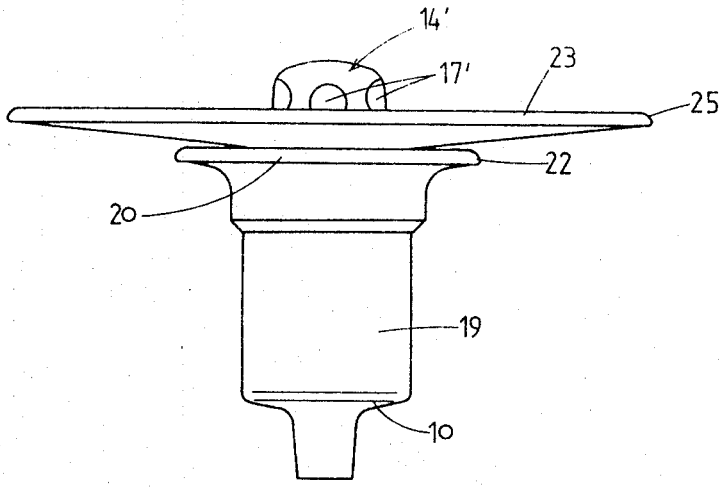
FIG. 1 is a side elevation view of one form of the bubble forming device.
Figure 2:
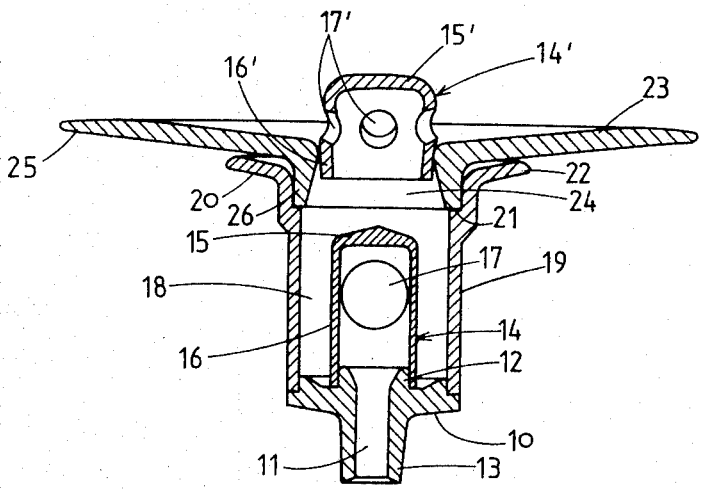
FIG. 2 is a sectioned elevation view of the device as shown in FIG. 1.

The device in one preferred form and as illustrated in the drawings is constructed so as to be demountable into its various component parts. In this form the device consists of a bubble engaging member 10 which is of circular shape when viewed in plan. Located centrally within member 10 is an air supply opening 11 which is formed to extend through member 10 and project either side thereof in tubular portions 12 and 13 which are formed integrally with member 10. Tubular portion 13 can form a mouthpiece whereby the user can blow through opening 11 but preferably this portion 13 is inserted in the end of a flexible tube through which the user can blow. Preferably the opening 11, where it passes through tubular portion 12, is outwardly flared as clearly shown in FIG. 2.

A cover 14 is located over the outlet end of the opening 11 and in the illustrated form is a press fit over the tubular portion 12. This cover 14 is in the form of a cap having an end portion 15 from which extends an annular skirt or wall 16. In the form of the cap illustrated in FIG. 2 a single aperture 17 is formed in the wall 16.

The device in this form can readily be used as a bubble forming device by dipping at least the end of cap 14 into a solution of soap or detergent, water and preferably salt. By blowing through opening 11 a bubble forms over cap 14 and engages, for support, with member 10. With a single apertured cover 14, a single bubble is shown and this bubble can be of large dimensions. If more than one aperture 17 is formed in the skirt 16 of cover 14 a multitude of interconnected bubbles are simultaneously blown.

In a further form of the device, an annular chamber 18 is formed by locating a wall 19 about the peripheral edge of member 10. In the demountable form which is illustrated, wall 19 is a separate element, though it will be appreciated that wall 19 and member 10 could be formed integrally. Wall 19 can be straight sided and formed with a rim 20 at its outer end, though in the illustrated form the open end of the chamber wall is slightly bell-mouthed to form a ledge 21 the reason for which will be described hereinafter.

Rim 22 extends outwardly from wall 19 and is preferably inwardly dished as shown. The peripheral edge 22 of rim 20 is of curved shape with the curvature preferably being compound in that the radius of curvature from the top surface of the rim 20 is greater than the radius of curvature from the bottom surface. It will be appreciated that when referring to top, bottom, upper or lower in the present specification, the terms are to be interpreted in view of the orientation of the device as shown in the drawings. It will be further appreciated that the device can be used in an inverted attitude as opposed to the attitude shown in the drawings.

The device as described with rim 20 can also be used as a bubble blowing device with a single apertured or multi apertured cover 14 in position over the end of air supply 11. The rim 20 is dipped into a bubble forming solution and air passing through opening 11 emits from aperture or apertures 17 to pass through chamber 18 and form a bubble on rim 20. In this form of the device the bubble engaging member is rim 20 and bubbles of large dimensions can be blown. With a single aperture cover 14 a single bubble is blown, whilst a cover having more than one aperture will permit the blowing of a number of bubbles simultaneously. The curved peripheral edge 22 permits a blown bubble to be readily disengaged and also ensures a supply of bubble forming fluid as fluid collects at a point which is approximately the transition between the two differing radii. This supply of fluid is of assistance when bubbles of large dimensions are being blown.

The device in its preferred form is provided with a disc 23 which is inwardly dished toward a central opening 24. The central opening 24 is preferably of a diameter which is less than the internal diameter of the chamber 18. Once again the peripheral edge 25 of disc 23 is of compound curvature with the upper radius being greater than the lower radius in the manner already disclosed with respect to the peripheral edge 22 of the rim 20. The disc 23 is conveniently mounted by a downwardly depending annular skirt 26 which located on ledge 21 in the wall 19. Annular skirt 26 is concentric with opening 24 which itself is concentric with chamber 18 and air supply opening 11.

Figure 3:
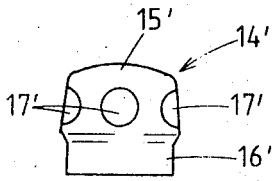
FIG. 3 is an elevation view of the cover which is positioned in the central opening of the disc of the device as shown in FIGS. 1 and 2.

In this form bubbles can again be blown though usually only single bubbles. To obtain a multitude of bubbles, which are blown simultaneously, a cover 14' is located in central opening 24. As with previously described cover 14, this cover 14' has a top portion 15' from which extends an annular wall or skirt 16'. The wall 16' is located in opening 24 and reference to FIG. 3 will show that the wall has an area of reduced diameter at its lower end so as to facilitate insertion in opening 24 and location on disc 23. Wall 16' has a number of apertures 17' with the number in the illustrated form being four. Cover 14' is removably mounted in opening 24 so that when multiple bubbles are to be blown, the cover can be readily inserted.

In use of this form of the device the disc is dipped into the bubble forming solution and single or multiple bubbles can be below depending on whether or not cover 14' is inserted. When cover 14' is in position, multiple bubbles of considerable size can be blown automatically and no skill is required. In addition the bubbles are blown randomly so that multiple bubbles of different formations are obtained.

When cover 14' is in position the lower cover 14 can be removed. Various different effects can be obtained by interchanging of covers 14 and 14' as well as other configurations of covers which may be desired. The versitility of the bubble forming device is thus greatly increased, as the removal of covers 14 and 14', disc 23 and wall 19 permit the device to be used in various forms and thus obtain differing bubbles and bubble formations. The interest of a child is therefore maintained and level of pleasure is thus increased. The device is preferably made of plastics material thus reducing the cost and weight. In view of its demountable form the device can be readily packed in a confined enclosure as well as allowing for any cleaning or drying which may from time to time be required.

What is claimed is:

1. A bubble-forming device comprising a shallow dish-shaped bubble engaging disc having an opening centrally disposed therein, means including spaced apart inner and outer circular walls forming an open ended chamber of annular cross-section located on the convex side of the disc; the open end of the chamber being in communication with said central opening of said disc, said inner wall having a lateral aperture in communication with said annular chamber and having an air supply inlet opening concentric with the open end of the chamber and central opening of said disc, a cover detachably mounted with said disc to cover said central opening, said cover having at least one aperture therein, said aperture being located so that air entering into said chamber via said inlet opening and said lateral aperture emits from said at least one aperture over the surface of said disc.

2. A bubble-forming device as in claim 1 wherein the cover is formed by a cap which has an end wall from which extends an annular wall, said at least one aperture being located in said annular wall.

3. A bubble-forming device as in claim 2 wherein the annular wall has a portion of reduced diameter which fits within said central opening.

4. A bubble-forming device as in claim 1 wherein said inner circular wall is formed by an additional cover detachably mounted to said device and positioned over said air supply inlet opening.

5. A bubble-forming device as in claim 1 wherein the peripheral edge of said disc is of curved cross-section.

6. A bubble-forming device as in claim 5 wherein the peripheral edge is of compound curvature with the radius of curvature extending from the upper surface being greater than that extending from the under surface.

7. A bubble-forming device as in claim 1 wherein an air supply tube is coupled to said air supply inlet opening.

8. A bubble-forming device as in claim 1 wherein the air supply inlet opening flares outwardly into the interior of said device.

* * * * *